US008733044B2

(12) United States Patent
Dollerup

(10) Patent No.: US 8,733,044 B2
(45) Date of Patent: May 27, 2014

(54) SECTIONAL RAIL SYSTEM AS BASE FOR A PLATE COVERING

(75) Inventor: Niels Dollerup, Esbjerg (DK)

(73) Assignee: Zak-It Systems GmbH, Menzingen (CH)

( * ) Notice: Subject to any disclaimer, the term of this patent is extended or adjusted under 35 U.S.C. 154(b) by 195 days.

(21) Appl. No.: 12/919,671

(22) PCT Filed: Feb. 26, 2009

(86) PCT No.: PCT/DK2009/050045

§ 371 (c)(1),
(2), (4) Date: Nov. 24, 2010

(87) PCT Pub. No.: WO2009/106083

PCT Pub. Date: Sep. 3, 2009

(65) Prior Publication Data

US 2011/0056155 A1 Mar. 10, 2011

(30) Foreign Application Priority Data

Feb. 27, 2008 (DK) ..... 2008 00270

(51) Int. Cl.

| | |
|---|---|
| ***E04F 19/04*** | (2006.01) |
| ***E04C 2/34*** | (2006.01) |
| ***E04B 7/04*** | (2006.01) |
| ***E04B 5/00*** | (2006.01) |
| ***E04B 2/00*** | (2006.01) |
| ***E04H 1/00*** | (2006.01) |

(52) U.S. Cl.
USPC ..... 52/290; 52/481.2; 52/92.1; 52/408; 52/762; 52/241; 52/481.1

(58) Field of Classification Search
USPC ..... 52/481.2, 92.1, 408, 762, 238.1, 241, 52/481.1, 290
See application file for complete search history.

(56) References Cited

U.S. PATENT DOCUMENTS

| | | | |
|---|---|---|---|
| 3,536,345 | A | 10/1970 | Leifer |
| 3,680,271 | A | 8/1972 | Satchell |

(Continued)

FOREIGN PATENT DOCUMENTS

| | | | |
|---|---|---|---|
| DE | 42 42 544 | A1 | 7/1994 |
| EP | 1 267 008 | A | 12/2002 |

(Continued)

*Primary Examiner* — Brian Glessner
*Assistant Examiner* — Omar Hijaz
(74) *Attorney, Agent, or Firm* — Sughrue Mion, PLLC

(57) ABSTRACT

The present invention concerns a sectional rail system which is constructed with the known outer rails with U-shaped cross-section and intermediate rails with C-shaped cross-section, and which is peculiar in that each of the retention means of the outer rail includes at least one stop pin which is disposed close to the inner side of the screw web of an outer rail, preferably two stop pins disposed opposite each other close to the inner side of the screw webs of the outer rail, where each stop pin furthermore is provided with a support flange for supporting an end part of the reinforcement web of the intermediate rail. The fastening means of the outer rail may thus include one, two or more stop pins, and one or more resilient lock pins.

Hereby may be achieved provision of a tool-free assembly method for the sectional rail system and that by screwing on plate covering close to the edge part of the intermediate rail, it is avoided that the screw web and the associated reinforcement web "capsize".

15 Claims, 7 Drawing Sheets

(56) References Cited

U.S. PATENT DOCUMENTS

| | | | | | |
|---|---|---|---|---|---|
| 3,720,995 | A | | 3/1973 | Brown et al. | |
| 3,989,399 | A | * | 11/1976 | Slowbe | 403/245 |
| 4,235,054 | A | * | 11/1980 | Cable et al. | 52/210 |
| 4,805,364 | A | | 2/1989 | Smolik | |
| 4,854,096 | A | | 8/1989 | Smolik | |
| 5,222,335 | A | * | 6/1993 | Petrecca | 52/105 |
| 5,325,651 | A | * | 7/1994 | Meyer et al. | 52/715 |
| 5,394,665 | A | | 3/1995 | Johnson | |
| 5,720,138 | A | * | 2/1998 | Johnson | 52/220.7 |
| 5,797,233 | A | | 8/1998 | Hascall | |
| 6,079,181 | A | | 6/2000 | Ruff | |
| 6,279,289 | B1 | | 8/2001 | Soder et al. | |
| 6,647,691 | B2 | * | 11/2003 | Becker et al. | 52/656.1 |
| 6,983,569 | B1 | * | 1/2006 | Rosenberg | 52/241 |
| 7,216,465 | B2 | * | 5/2007 | Saldana | 52/655.1 |
| 7,770,348 | B2 | * | 8/2010 | Tollenaar | 52/481.1 |
| 7,975,448 | B2 | * | 7/2011 | Jahn et al. | 52/506.07 |
| 2006/0010811 | A1 | * | 1/2006 | Platt | 52/506.06 |
| 2007/0011971 | A1 | | 1/2007 | Sitkiewicz | |
| 2007/0119843 | A1 | | 5/2007 | Ball | |
| 2009/0133356 | A1 | | 5/2009 | Zadeh | |

FOREIGN PATENT DOCUMENTS

| | | | |
|---|---|---|---|
| GB | 1 468 190 | A | 3/1977 |
| GB | 2 275 280 | A | 8/1994 |
| WO | 2007/136368 | A | 11/2007 |

* cited by examiner

SECTIONAL RAIL SYSTEM AS BASE FOR A PLATE COVERING

FIELD OF THE INVENTION

The present invention concerns a sectional rail system for constructing a base for plate covering, where the sectional rail system includes at least two outer rails between which are provided at least two intermediate rails, where the outer rails have U-shaped cross-section, including a sectional back and two screw webs, where the intermediate rails have C-shaped cross-section, including a sectional back and two screw webs and two inwardly projecting reinforcement webs, where each outer rail has a retention means, preferably several retention means disposed with a spacing in longitudinal direction of the outer rail, where each of the intermediate rails are with two end parts, where each of the two end parts are fastened to a retention means of an outer rail, the retention means including at least one stop pin and at least one resilient lock pin, where the stop pin is provided with arresting means for the end part of an intermediate rail, where the lock pins are with resilient means for passage of an end part of an intermediate rail and for retention of the same end part on the same intermediate rail against the stop pin in the retention means, respectively.

BACKGROUND OF THE INVENTION

The prior art sectional rail systems for construction a base for plate or board covering often find application in non-bearing or bearing walls. These walls may serve as partitionings and are therefore often provided with doors for access between the rooms concerned. The plate covering frequently consists of plaster boards, as this type of plate has a fire-inhibiting effect and which is economically attractive at the same time. The plaster boards are coated with a cardboard layer contributing to distribution of surface tensions such that the porous plaster board can be handled on the construction site and be screwn onto the underlying construction without breaking.

The sectional rail system consists largely of two kinds of sections—an outer rail and an intermediate rail. The outer rails are often with U-shaped cross-section and the cross-section of the intermediate rails is C-shaped. The cross-sections of both outer and intermediate rails include a sectional back and perpendicularly thereto there is typically two screw webs that lie approximately in parallel opposite each other, forming the base on which the plate covering is laid on and fastened to by screws. At the intermediate rails, the screw webs are reinforced by each their reinforcing web facing approximately perpendicularly inwards in relation to the screw web, whereby the C-shape is approximated.

By mounting, the outer rails are typically fastened in parallel at opposing external limits, most often at ceiling and floor, and with the opening of the outer rails facing against each other. By internal walls, an outer rail is therefore frequently used along the floor and correspondingly along the ceiling. The C-shaped intermediate rails may then be placed in the outer rails, after which the rail assembly is made. By the prior art techniques, this mounting work can be performed in the following ways with associated disadvantages:

By the technique used the most, the distance between the intermediate rails is set out by marking on each of the two mounted outer rails. Then the intermediate rails are pushed into the outer rails, after which they are fixed by fixing tongs that cut a collared hole through both sections. After that, possible insulation in the form of batts with a size corresponding to modular dimensions is mounted between the intermediate rails, and the plaster boards are screwed on the intermediate and outer rails. There are the following disadvantages by this prior art:

- The modular dimensions between the intermediate rails may easily deviate, whereby the plaster board cannot be screwed on the intermediate rails with the required exact dimensions from screws to plate edge.
- The fixing by the fixing tongs frequently cannot stand when the workmen press the insulation into position.
- When screwing the plaster boards on, it is often difficult for a self-tapping screw to get hold of the screw webs at the end parts of the intermediate rails. This is due to the fact that the aforementioned fixing cannot secure the screw web of the intermediate rail to the required extent. Hereby, the screw is just pushing the end part of the screw web of the intermediate rails inwards, and the self-tapping screw can not be fastened at the lower edge of the plate covering thereby, why the plate covering remains loose in this area. Particularly around doors where dynamic action on the plate covering may occur regularly, this can result in that the plate covering of the wall works loose, thereby putting greater demands on maintenance. This depreciation of quality is unwanted in modern building construction.
- The rail assembly is time-consuming as, for example, 8.88 rail joints have to be made per meter of wall when the intermediate rail spacing is 450 mm. The construction worker has to carry the fixing tongs with him by each rail assembly and has to provide possibility of an efficient working position, implying a not insignificant work environment challenge as the rail assembly work has to take place partly close to a ceiling far above the height of a man and partly close to the floor.

Another prior art is found in U.S. Pat. No. 3,680,271. Here, punchings are made in the outer rails and the intermediate rails exactly corresponding to each other such that they may be clicked together. Thereby it is possible to click the intermediate rails securely into position without measuring.

- Since the intermediate rails are to be displaced perpendicularly into both outer rails, it is necessary to assemble the entire sectional rail system at a place with ample space around for subsequently erecting the sectional rail system (the wall) in one piece and securing it at the place of building-in.
- Moreover, there is therefore to be made intermediate rails that fit the given ceiling height since shortening at the mounting site cannot be effected as the possibility of rail assembly by clicking together is rendered impossible if the intermediate rails are shortened.
- The system is not flexible as intermediate rails have to be made for any ceiling height that may occur in a given building project, requiring substantial resources for planning the sectional rail system.
- The lateral flanges on the intermediate rails are not kept firmly in against the lateral flanges on the bottom and top rails. The intermediate rails may thus be pressed out of their click-lock when screwing into the lateral flange on the intermediate rails. The intermediate rails may hereby be displaced and the screw may have difficulty in getting hold, to the detriment of the quality of the work performed.

A third prior art is known from U.S. Pat. No. 3,720,995. Here, stop pins are provided on the outer rails, and corresponding lock pins at the inner side of the profiled back. Thus the work with marking the position of the intermediate rails is avoided. Moreover, the fitting work is facilitated as no hand tools have to be used by the fastening of the intermediate rails. The drawbacks of this prior art is:

- There is required a very exact shortening of the intermediate rails as even small deviations of the length of the intermediate rails can entail that some of the intermediate rails will slide out of the locking pins. The cutting tools used by the workmen for shortening frequently do not have the required precision.
- In practice, it will imply requirements to factory made intermediate rails and putting the outer rails on chocks, implying great demands on both construction site logistics, planning and mounting work.
- The lateral flanges on the intermediate rails are not kept firmly in towards the lateral flanges on the bottom and top rails at the rail joint. The intermediate rails may hereby be displaced and the screws may have difficulty in getting hold, to the detriment of quality.

Concerning establishing door and window apertures, this work is tedious by all prior art sectional rail systems, why it is left to the building worker's creativity to provide the wanted door and window apertures. Thus, by the prior art for establishing a door aperture it often occurs that one of the intermediate rails are moved half an intermediate rail width, such that a door aperture can assume a standard width of e.g. 900 mm, 1000 mm or 1100 mm. Vertically over the door, two intermediate rails are mounted juxtaposed in order to compensate for the displaced intermediate rail. This is only manifested if the position of the door fits into a modular system of 450 mm. If it is not positioned according to a modular system, two extra intermediate rails have to be used. A unnecessary use of material is thereby produced at the establishing of a door and window apertures in the prior art systems.

Between the two vertical intermediate rails at the door or window aperture, a horizontal lintel is mounted. This is frequently made on the spot of a piece of outer rail which is worked with sheet metal scissors in order to be assembled with the intermediate rails. This is a cumbersome and time-consuming work that reduces the efficiency in the building process.

The mentioned switching around of the intermediate rails at the door and window apertures entail that the advantages of the modular disposition of the intermediate rails cannot be utilised around the door and window apertures. Insulation batts, which have standard dimensions, thus have to be adapted by cutting in all fields around the door and window apertures, which is a relatively time-consuming process.

In addition, in modern construction there are great demands to the quality and productivity in performing the work. Research shows that there is a special need for innovation within the building sector. Here, there is pointed to new thinking for building processes and projecting whereby a greater productivity can be created within the sector. The present invention fulfils the desire for optimisation of the building process by the often used sectional systems for plate covering to the benefit of the productivity in the building sector.

OBJECT OF THE INVENTION

The purpose of this invention is to indicate a sectional rail system which may ensure a stable base for a plate covering so that the above drawbacks are avoided. At the same time is ensured a tool-free rail assembly in the sectional rail system, including rail assemblies around door and window apertures to be established in the sectional rail system. Thus is ensured a rapid mounting.

DESCRIPTION OF THE INVENTION

According to the present invention, this object is achieved by a sectional rail system of the type mentioned in the introduction, which is peculiar in that each of the retention means of the outer rail includes at least one stop pin which is disposed close to the inner side of the screw web of an outer rail, preferably two stop pins disposed opposite each other close to the inner side of the screw webs of the outer rail, where each stop pin furthermore is provided with a support flange for supporting an end part of the reinforcement web of the intermediate rail. The fastening means of the outer rail may thus include one, two or more stop pins, and one or more resilient lock pins.

A stop pin has the purpose of forming a stop for the end part of an intermediate rail. This means that it is a stop pin as soon as the U-shaped outer section is supplied with any kind of device preventing the movement of the intermediate rail in the entire free space provided between the planes constituted by the screw webs of the outer rail.

The stop pin may appear by machining the sectional material of the outer rail, e.g. by punching, collaring, bending or a combination of one or more of these machining methods. Alternatively, the stop pin may appear by fastening any other component in the space delimited by the two screw webs of the outer rail, i.e. both down in the U-section and outside the U-section close to the edges of the two screw webs.

A resilient lock pin in the retention means is provided with resilient means for enabling passage of an end part of an intermediate rail and for retention of the same end part on the same intermediate rail against the stop pin in the retention means, respectively. The resilient means in the lock pin may appear by machining the sectional material of the outer rail, e.g. by punching, collaring, bending or a combination of one or more of these machining methods. Alternatively, or supplementing, the resilient means in the lock pin may appear by fastening any other component which either by itself or interacting with the stop pin or the support flange constitutes a resilient part. An action by the resilient part causes an elastic and thereby non-permanent deformation of the resilient part, preferably such that the resilient part can return entirely or partly to its initial position under abutment with part of the end part of the intermediate rail in order thereby to form retention of the end part of the intermediate rail against the aforementioned stop pin.

A sectional rail system which is designed with the prior art outer rails with U-shaped cross-section and intermediate rails with C-shaped cross-section as described above, and which has the peculiar features mentioned in claim 1 with one or more stop pins with associated support flange, has the advantage that the screw web at the lower end part of the intermediate rail which during screwing on of the plate cover by the prior art sectional systems does to have sufficient support, this screw web is now supported via a support of the inwardly projecting reinforcement web where this support is constituted by the support flange on the stop pin.

Hereby is achieved that by screwing on plate covering close to the edge part of the intermediate rail, it is avoided that the screw web and the associated reinforcement web "capsize". The support flange ensures a sufficient retention for the force applied to the screw web during screwing, e.g. with a self-tapping or self-cutting screw. The support flange thus provides for the screw web remaining in position during the screwing such that the screw get sufficient hold of the base, thereby becoming mounted correctly.

At the same time, by disposing the stop pin close the screw webs of the outer rail it is possible the achieve a solution where the length of the intermediate rails may vary within an appropriate tolerance range corresponding to a usual length tolerance when adaptation of sectional length occurs on a construction site.

At the same time, a tool-free rail assembly is ensured where the assembling of the assembly with the outer rails can be performed without the building worker needing to establish a secure working position close to each single joint at each side of the sectional system, where the building worker is to ensure correct rail assembly with a hand tool. The building worker may just perform the rail assembly after a fastening the outer rails by pushing a first end part of an intermediate rail in against the stop pins in the first outer rail, after which the second end part of the intermediate rail is brought to abut on the stop pins of the second outer rail by letting this second end part of the intermediate rail pass the resilient means of the lock pin in beforehand, whereby these resilient means are temporarily deformed resiliently in order thereby to return entirely or partly to the initial position of the resilient means at a position where the resilient means are brought to abut on the second end part of the intermediate rail.

In a further embodiment, at least one support flange may be with a lock pin. By disposing the lock pin on the support flange, it is possible to fasten the intermediate rail in an unchanged way at door and window apertures. When establishing door and window apertures in a wall consisting of sectional rail system with plate covering, rails are to be provided around along the entire door aperture, i.e. at each side of the door aperture and above the door aperture. Usually, the presence of a sectional rail at the bottom of the door apertures is not wanted, since it is often decided to let a door threshold come as close as possible to the underlying floor structure in order to avoid unnecessarily high doorsteps or door thresholds. The outer rail running along the floor is thus to be interrupted in its course at the spot where the door aperture is to be. This is effected by sawing through the outer rail such that the sawn off end finishes immediately at the door aperture. Then it is possible to dispose the sawn off part of the outer rail at a run starting at the other side of the door aperture.

Along the sides and the top of the door aperture, the present rails are to have the sectional back face the door apertures such that there is a surface against which the door frame can be fastened and sealed.

By the prior art sectional rail systems, no allowance has been made for tool-free establishing of door and window apertures. By a lock pin placed on the support flange according to this embodiment of the invention, the outer rail can be sawn off at this point in relation to the retention means of the outer rail, entailing that the subsequently mounted intermediate rail will have the sectional back facing the door aperture and be retained in the retention means in the same way as the other intermediate rails where the rail assembly is also performed without use of tools.

In a further preferred embodiment, each support flange on each stop pin may be provided with lock pin. It is thus ensured that the intermediate rail is retained close to both screw webs of the outer rail, whereby a force action of a typical size attacking the intermediate rail, irrespective of the acting direction of the force, may be transmitted from the intermediate rail to the outer rail, and thereby be absorbed in the surrounding structure without giving rise to deformation.

By a particularly preferred embodiment, the sectional rail system may furthermore include at least one lintel rail and at least one further intermediate rail, where the distance between each of the at least three intermediate rails has uniform modular spacing, where the cross-section of the lintel rail corresponds to the cross-section of an outer rail, and where the lintel rail is provided with a number of retention means corresponding to the retention means of an outer rail. Hereby is achieved a modular design where the intermediate rails are mounted uniformly with respect to fastening as well as disposition. The lintel rail thus ensures a retention means for the intermediate rails that are above the door aperture, corresponding to the retention devices at the other intermediate rails in the sectional rail system. Thereby it is not necessary with ad hoc solution at doors performed at the individual construction site, as the tool-free rail assembly according to the invention is also used here.

In a further variant of the invention, each end part of the said lintel rail may be provided with fastening means for fastening to an intermediate rail. This entails the possibility of a tool-free solution for fastening the lintel rail and at the same time ensuring correct disposition of the same.

By a preferred variant of the invention, the length of the lintel rail may correspond to a multiple of the modular spacing between intermediate rails, preferably a multiple of three times the modular spacing. This means that the lintel rail can be prefabricated with a uniform length such that below the lintel rail, space is created for the door and window aperture in the opening produced thereby. The top edge and one side of the produced aperture will then constitute the top edge and one side of the final door or window aperture. The opening under the lintel rail will be equal to or larger than the desired total door width.

In a further preferred embodiment, each of the intermediate rails may be provided with a number of cutouts that correspond to the position of the fastening means of a lintel rail and spaced apart from any of the ends of the intermediate rail, and against the sectional back of the intermediate rail and against the reinforcement flanges of the intermediate rail. Thereby, all intermediate rails can be made as identical standard sections as each intermediate rail may be equipped with the option of fastening the lintel rail in a tool-free way in the intermediate rail. It is thus not required to plan disposition of the specially designed intermediate rails in beforehand in the vicinity of door or window aperture, making the construction work easier and reducing the risk of time-consuming errors.

The mentioned cutouts corresponding to the fastening means of the lintel rail may also be any other counterpart to the fastening means of the lintel rail, whereby it is ensured that the fastening can be performed without use of tools. Instead of cutout, the counterpart for the said fastening means may appear by machining the sectional material of the outer rail, e.g. by punching, collaring, bending or a combination of one or more of these machining methods. Alternatively, or supplementing, the counterpart to the said fastening means may appear by fastening any other component which either by itself or by interaction with a machining of the intermediate rail may constitute the mentioned counterpart for the fastening means of the lintel rail.

In a further variant, the fastening means of the lintel rail may be constituted by at least one tongue with resilient lock pin for inserting into and fastening to cutouts in an intermediate rail. Hereby is achieved a solution that ensures good fastening of the lintel rail such that it is secured against sliding down, as the lintel rail has projections into two intermediate rails. It may be advantageous that the cutout in the intermediate rails weakens as small part of the cross-section in the intermediate rail as possible, as it is the cross-section which determines the moment of inertia of the intermediate rail and thereby the stability against crosswise actions on the wall and thereby the intermediate rail. Advantageously, the cutout may thus be a slot provided with its longitudinal axis approximately in parallel with the longitudinal axis of the intermediate rail. The said tongue with resilient lock pin is described closely in the detailed part of the description; see the latter.

In an embodiment which is to be particularly preferred, the sectional rail system may furthermore include at least one door side section, wherein each end part of the door side section is provided with fastening means at one end thereof for fastening to an outer rail, and at the other end thereof provided with fastening means for fastening to a lintel rail. Thereby it is only necessary with two special sections in the sectional system in order to establish a door aperture, namely a lintel rail and a door side section. This means that the problematic solutions of the prior art rail systems, e.g. the use of double sections by common internal doors, are made superfluous.

The door side section may have a cross-section corresponding to the cross-section of the intermediate rails, or the door side section may be wider than the outer rail. Since doors most often appear with a standardised height, the sectional length of the door side section may correspond to the standard door height.

The door side section is fastened by a joint at the top to the lintel rail and a joint at the bottom at the outer rail.

The fastening means for the said joints may assume many forms, possibly corresponding to the forms of retention described for the other rail joints in the sectional rail system. An example of the fastening means of the door side section is described in the detailed description of the drawing.

DESCRIPTION OF THE DRAWING

The invention will be explained below with reference to the accompanying drawing, wherein.

DETAILED DESCRIPTION OF THE INVENTION

Figure 1:
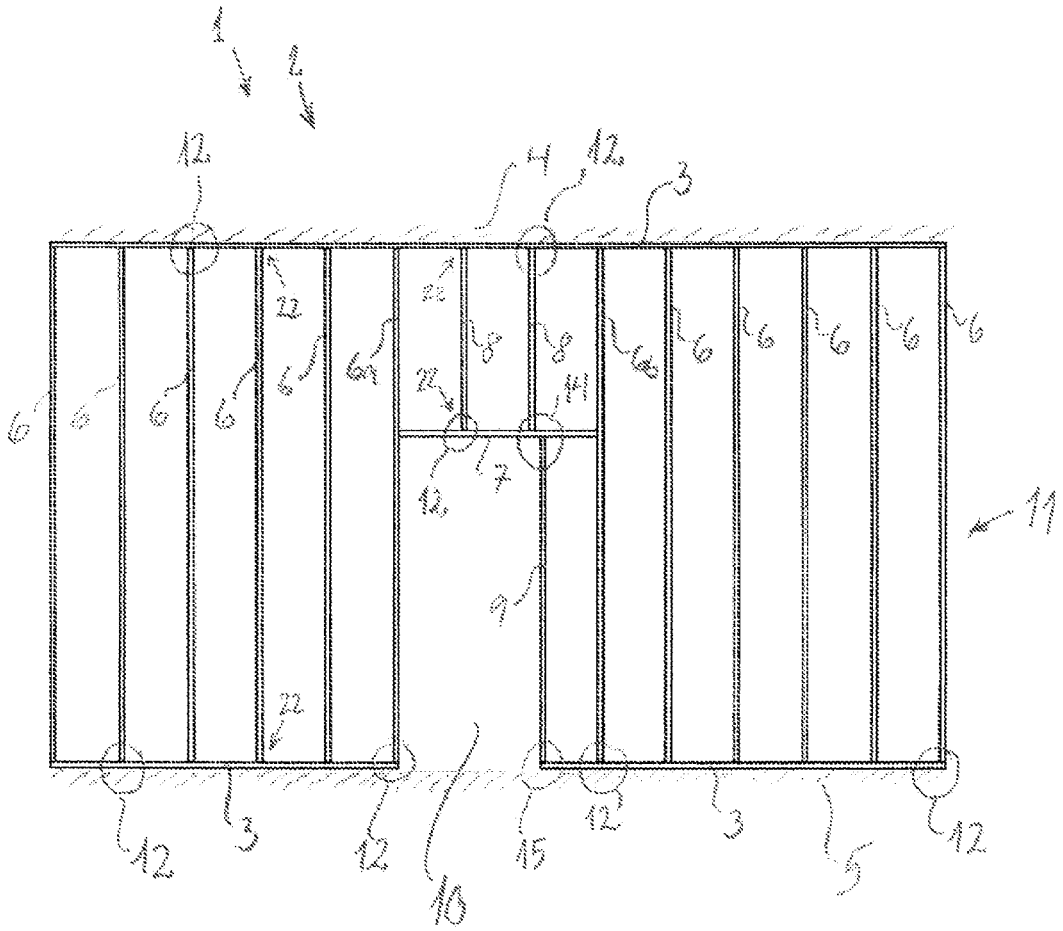
FIG. 1 is an elevation of a wall without plate covering, formed by the sectional rail system.

On FIG. 1 appears how a sectional rail system 1 according to the invention can be used for constructing a base 2 for plate covering, where the shown sectional rail system 1 has three outer rails 3, one outer rail along the upper edge against a ceiling structure 4 and two along the bottom edge against a floor structure 5. Twelve intermediate rails 6-6*b* are provided between the outer rails 3.

A lintel rail 7 is provided between two of the intermediate rails 6*a* and 6*b*. Above this, between this lintel rail 7 and the outer rail 3 mounted against the ceiling structure 4 there are mounted two shorter intermediate rails 8 with a cross-section corresponding to the other intermediate rails 6-6*b*.

A door side section 9 is provided under the lintel rail 7. Thereby appears a door aperture 10 such that the sectional rail system 1 in this way may be used for constructing a partitioning structure 11 where space for a door is desired.

Figure 2:
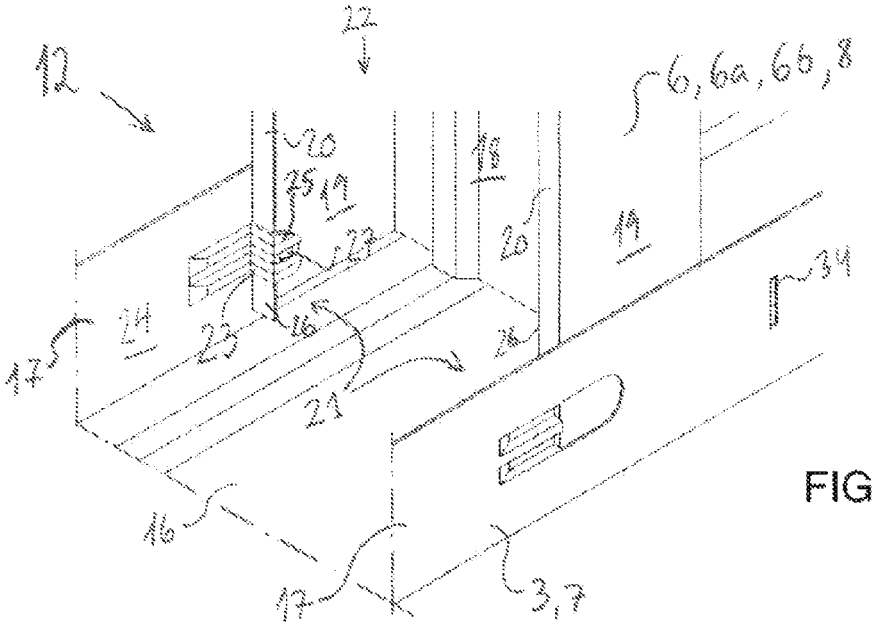
FIG. 2 is a detail of a rail joint between intermediate rail and outer rail.
Figure 3:
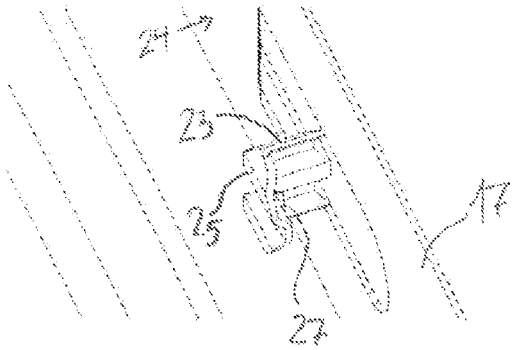
FIGS. 3 and 4 are details of the retention means of the outer rail.
Figure 4:
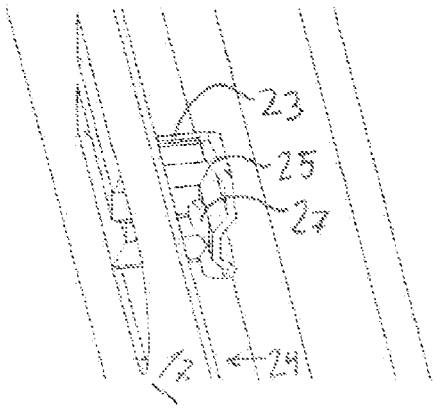
Figure 5:
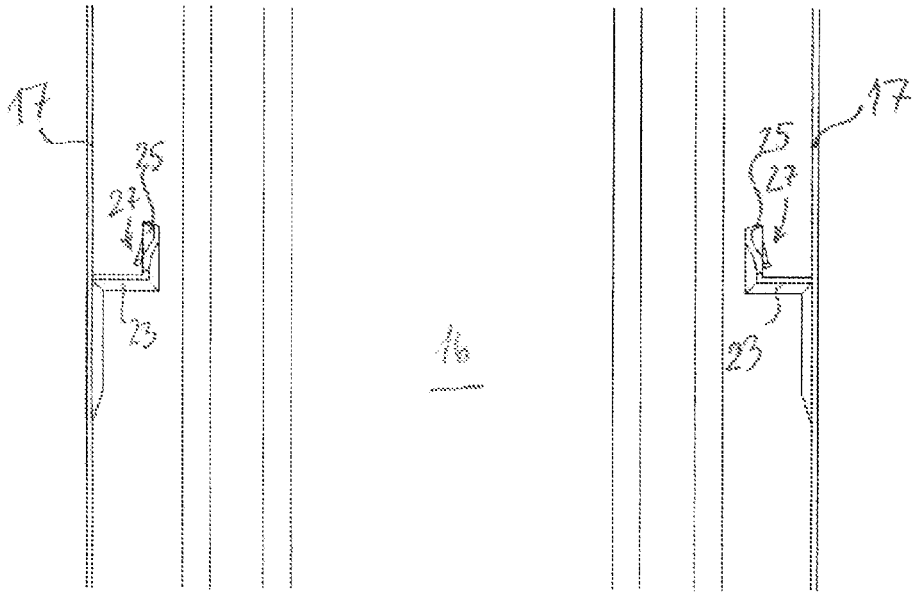
FIG. 5 is a detail of a plan of the outer rail, as seen from above.
Figure 6:
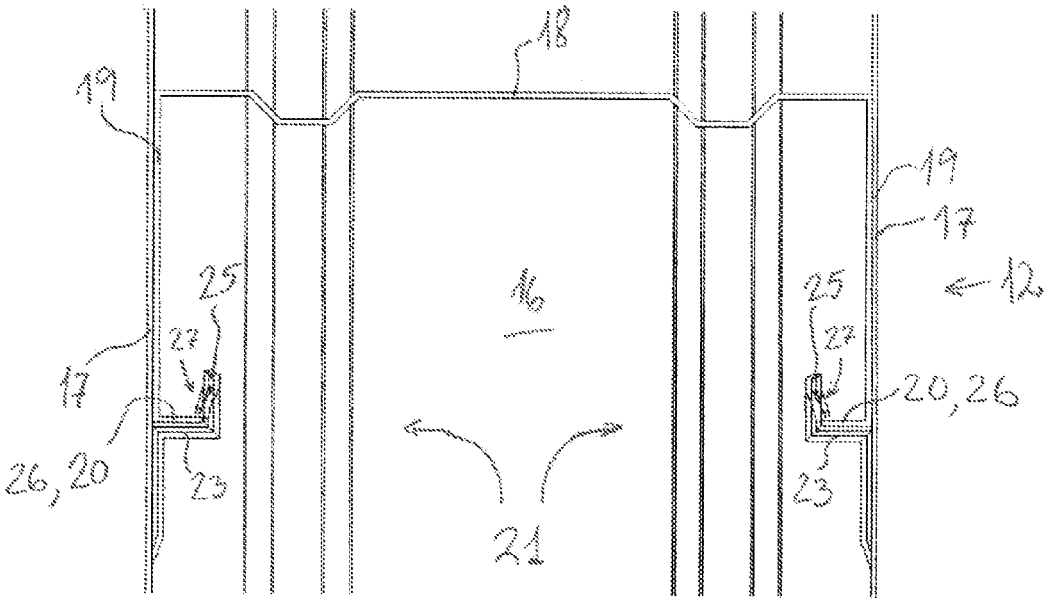
FIG. 6 is a detail of a plan of the outer rail, as seen from above, with inserted intermediate rail.

The rail joint 12 between an intermediate rail 6, 6*a*, 6*b*, 8 and an outer rail 3 or lintel rail 7 is shown in more detail on FIGS. 2 and 6. Joint 13*a* of lintel rail 7 and intermediate rail 6*a* is shown on FIG. 9. Joint 13*b* of lintel rail 7 and intermediate rail 6*b* is shown on FIG. 10. Joint 14 between door side section 9 and lintel rail 7 is shown on FIG. 11. Joint 15 between door side section 9 and outer rail 3 against floor structure 5 is shown on FIG. 12.

On FIGS. 2-6 is thus shown rail joint 12 and details of the technical features forming part of the rail joint 12. Outer rail 3 or lintel rail 7 has U-shaped cross-section, including a sectional back 16 and two screw webs 17.

Intermediate rails 6, 6*a*, 6*b*, 8 have C-shaped cross-section, including a sectional back 18 and two screw webs 19 and two inwardly projecting reinforcing webs 20. When the intermediate rail 6, 6*a*, 6*b*, 8 has been mounted in the outer rails/lintel rail 3, 7, the sectional back 18 of each intermediate rail 6, 6*a*, 6*b*, 8 is narrower than the sectional back 16 of the outer rails/lintel rails 3, 7 such that the width of the sectional back 18 corresponds to the spacing between the screw webs 17 of the outer rails/lintel rails 3, 7 when the intermediate rail 6, 6*a*, 6*b*, 8 is mounted in the outer rails/lintel rail 3, 7.

Each outer rail/lintel rail 3, 7 has a retention means 21. Each of the intermediate rails 6, 6*a*, 6*b*, 8 is provided with two end parts 22 of which one is shown on FIG. 2. The end part 22 is fastened in the shown fastening means 21.

The fastening means 21 include two stop pins 23 that are mutually opposed close to the inner side 24 of the screw webs 17 of the outer rail 3. The stop pin 23 forms a stop for the end part 22 of an intermediate rail. Each stop pin 23 is furthermore with a support flange 25 for supporting an end part 26 of the reinforcing flange 20 of the intermediate rail.

Moreover, by this embodiment appear lock pins 27 with resilient means for enabling passage of an end part 22 of an intermediate rail 6, 6*a*, 6*b*, 8 and for retention of the same end part 22 on the same intermediate rail 6, 6*a*, 6*b*, 8 against the stop pin 23 in the retention means 21, respectively. The lock pins 27 are disposed on the support flange 25 with the above described advantages provided thereby.

Figure 7:
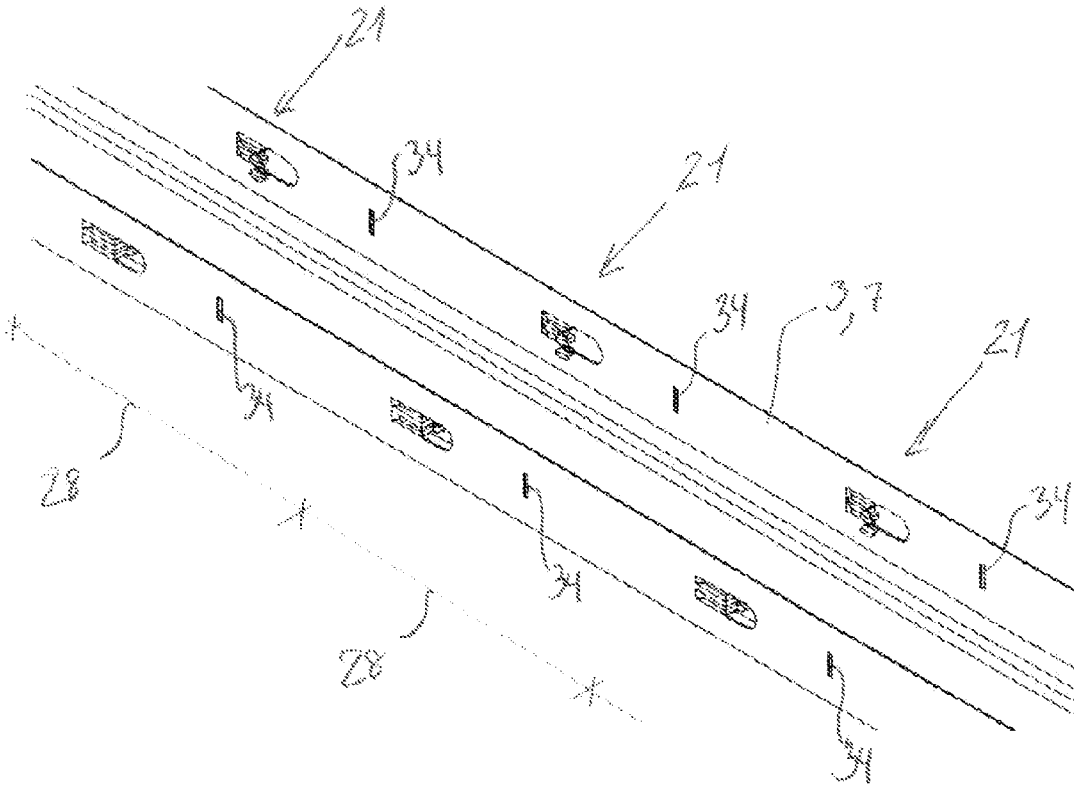
FIG. 7 shows a piece of an outer rail/lintel rail with retention means disposed at intervals.

FIG. 7 shows how each outer rail/lintel rail 3, 7 has several retention means 21 disposed at intervals 28 in longitudinal direction of outer rail/lintel rail 3, 7. The length of the lintel rail 7 corresponds to a multiple of the modular spacing between intermediate rails, preferably a multiple of three times the modular spacing, see FIG. 1. The interval 28 can e.g. be 150 mm, whereby the sectional rail system 1 may be used both as base for 900 mm and for 1200 mm plasterboards as plate covering.

Figure 8:
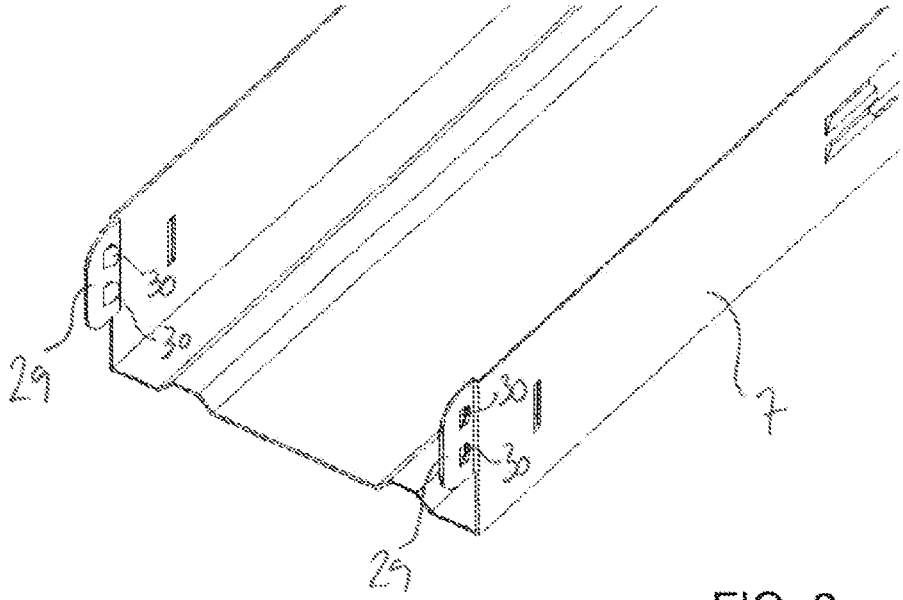
FIG. 8 is a detail of an end part of lintel rail.
Figure 9:
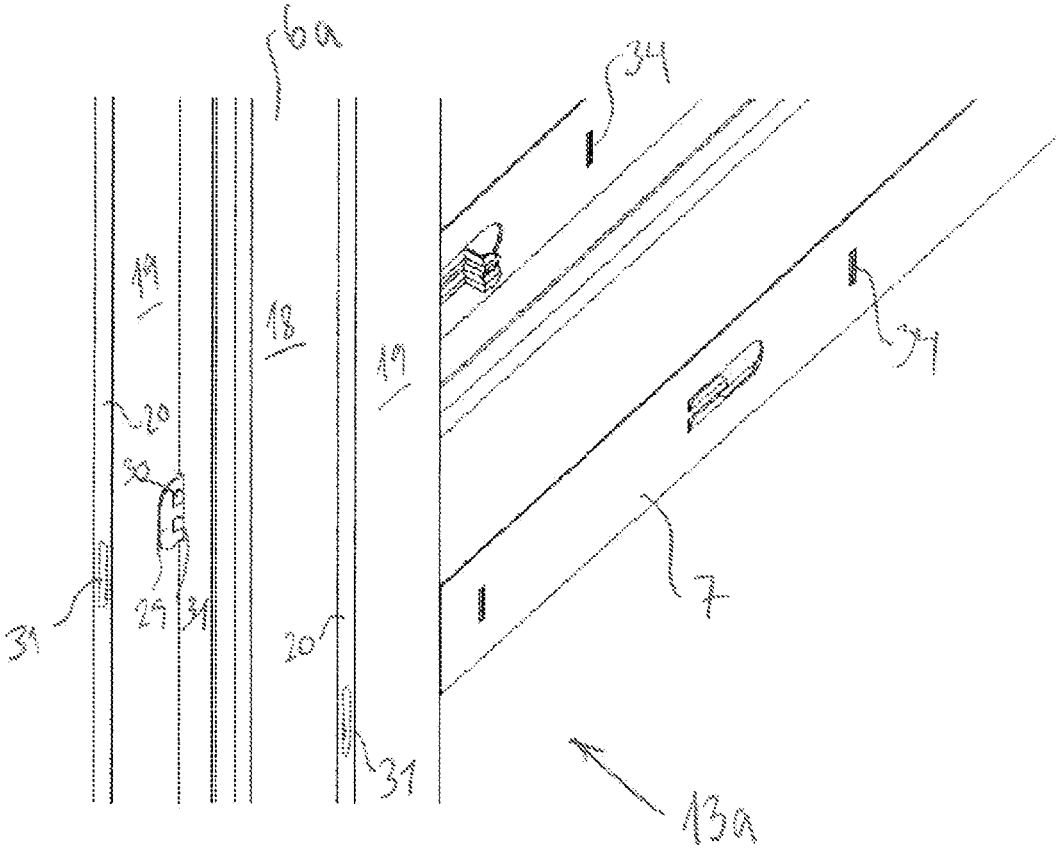
FIG. 9 is a rail assembly—intermediate rail and lintel rail—against the sectional back of the intermediate rail.
Figure 10:
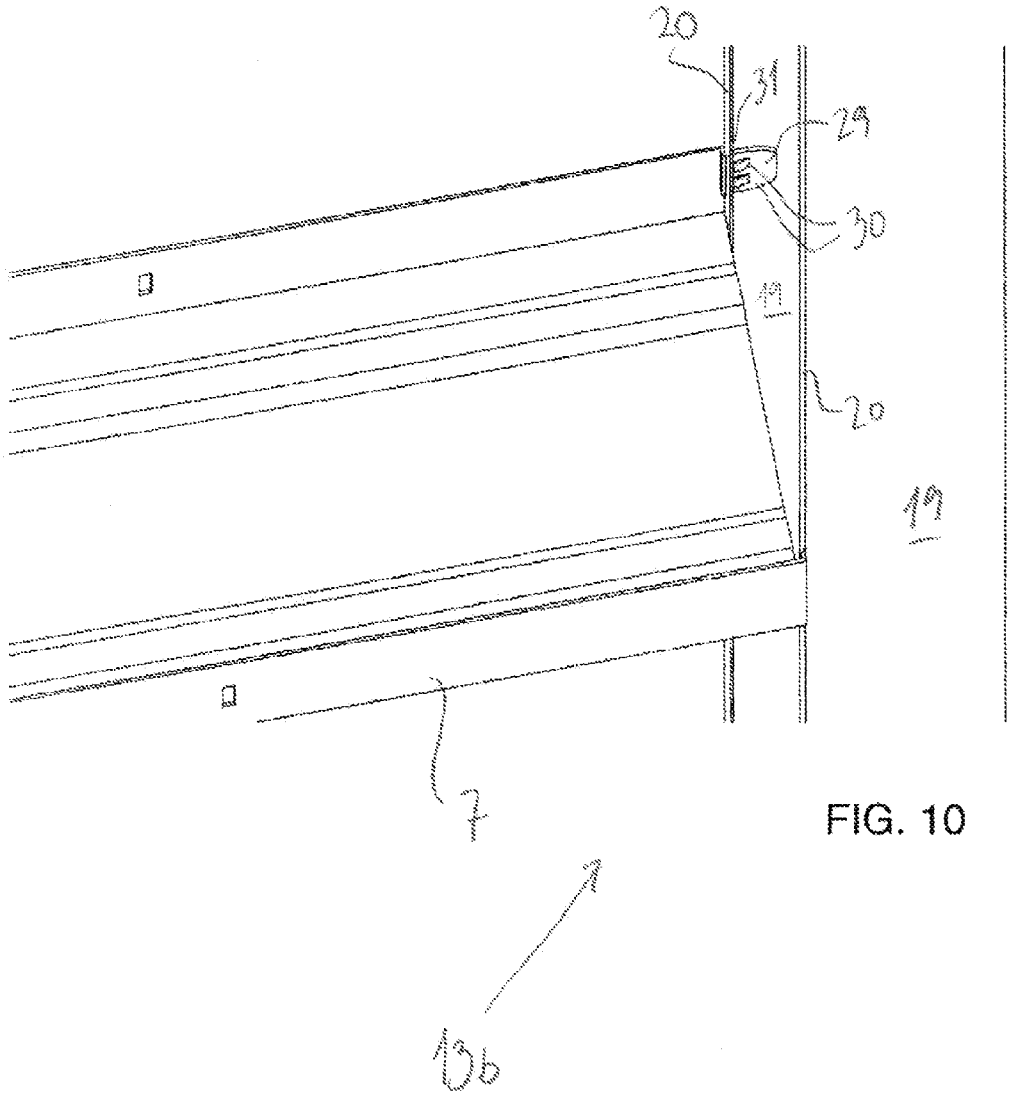
FIG. 10 is a rail assembly—intermediate rail and lintel rail—against the reinforcing webs of the intermediate rail.

From FIG. 8-10 appear how the lintel rail 7 of the sectional rail system can be fastened to the intermediate rails 6*a*, 6*b* via joint 13*a*, 13*b*. At each end, the lintel rail 7 has been provided with two projecting tongues 29 that may be projecting parts of the lintel rail section material itself. These tongues 29 are added two punched resilient barbs 30 during the machining.

In the intermediate rails 6*a* and all other intermediate rails 6, 6*b*, 8, cutouts 31 corresponding to the shown tongues 29 are formed. These cutouts 31 extend along the intermediate rails 6, 6*a*, 6*b*, 8 in order to weaken the force transmission ability of the cross-section the least possible. The tongues 29 may thus be inserted into each their cutout 31 where the shown barbs 1 yield a bit and move back to their initial position when the tongue 29 has been inserted through the cutout 31. The said cutouts 31 are made at the same distance from any of the ends 6, 6*a*, 6*b*, 8 of the intermediate rails, both in the sectional back 18 of the intermediate rail 6, 6*a*, 6*b*, 8 and in the reinforcing flanges 20 of the intermediate rail 6, 6*a*, 6*b*, 8. Any intermediate rail 6, 6*a*, 6*b*, 8 can be made by a shortening of an intermediate rail section in standard length delivered to the construction site, packed with corresponding intermediate rail sections in a standard length which is greater than the required length in most buildings. Any of the intermediate rail sections is taken from the delivered packet, after which the intermediate rail section, starting from one of the section ends, is shortened to the right length for the intermediate rails 6, 6*a*, 6*b*, 8, thus achieving having precisely disposed cutouts 31, irrespectively of which of the two ends of the intermediate rail section the shortening is established from.

Figure 11:
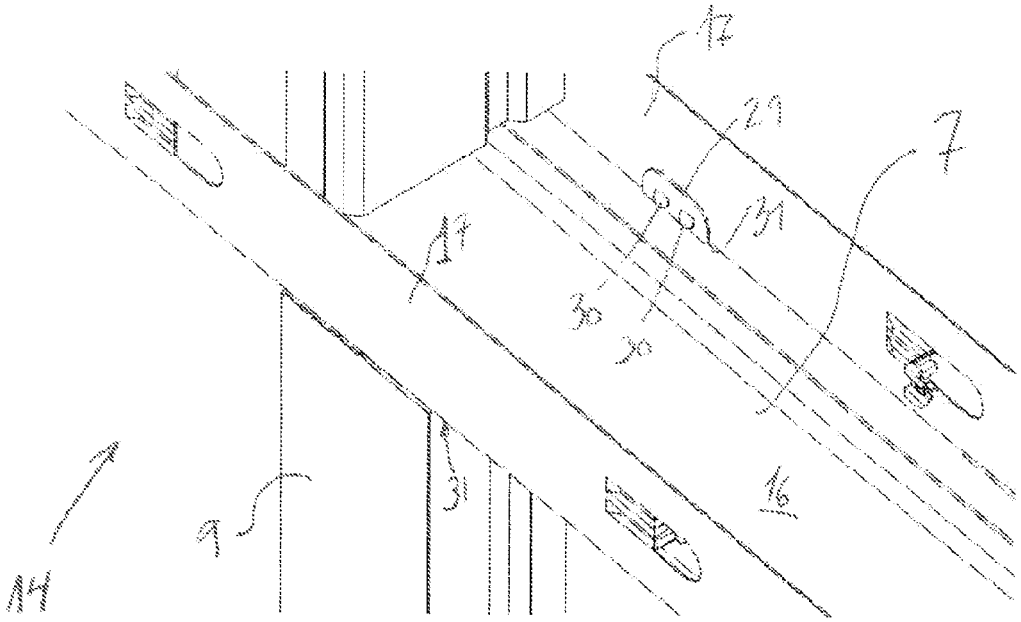
FIG. 11 is a detail of a rail joint between lintel rail and door side section.
Figure 12:
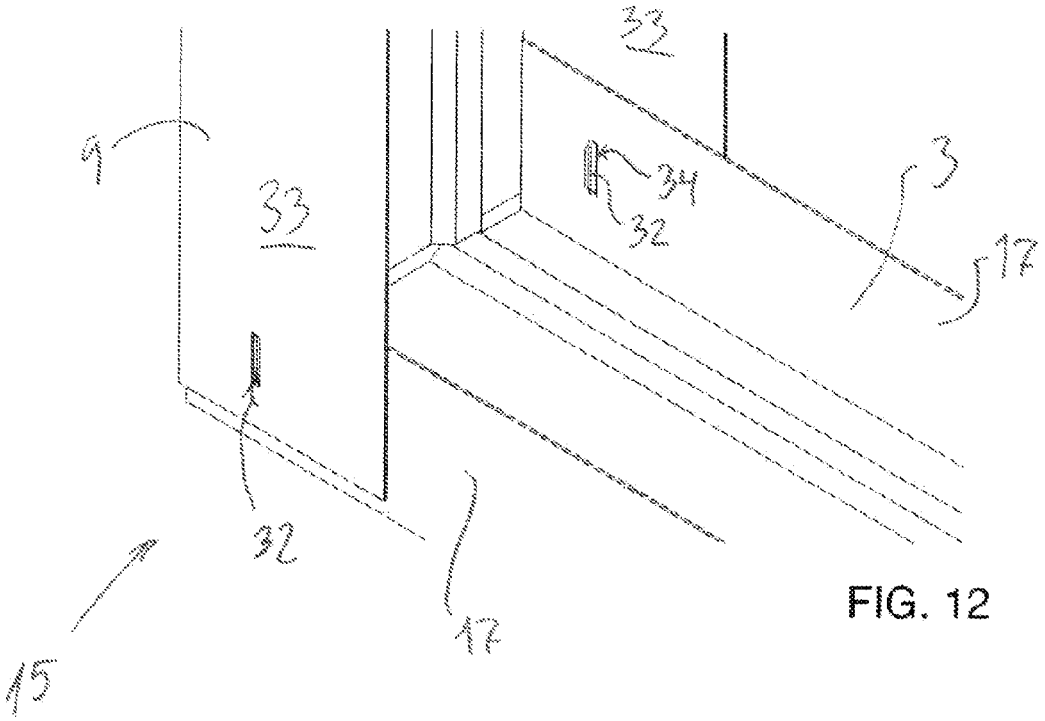
FIG. 12 is a detail of a rail joint between door side section and outer rail.

FIGS. 11 and 12 indicate joints 14, 15 for the door side section 9 in the sectional rail system 1. The shown door side section 9 has a U-shaped cross-section such that it surrounds the outer rail 3. The door side section may also be designed corresponding to the intermediate rails 6, such as a C-shaped cross-section that fits inside the outer rails 3.

Against the joint 14, the door side section 9 is equipped with tongues 29 with barbs 30 corresponding to those of the lintel rail. Correspondingly, the lintel rail is provided with cutouts 31 at each side of the sectional back 16 close to both screw webs 17. More cutouts 31 may be added, corresponding to desired standard widths of door and window apertures 10. A barb 32 punched in the screw webs 33 themselves for the door side section 9 is added to the door side section 9 against joint 15. Correspondingly, in screw flanges of outer rail 3 there is made a cutout 34 such that the barb 32 can engage the said cutout 34.

In order not having to plan the position of the door aperture 10 prior to delivery of sections to the construction site with the resources implied therewith, it will be expedient to make the cutout 34 at suitable intervals along all screw webs 17 of the outer rails.

The invention claimed is:

1. A sectional rail system for constructing a base for plate covering, including an outer rail extending in a first direction and having a U-shaped cross-section, including a sectional back and two screw webs, and an intermediate rail having a C-shaped cross-section, including a sectional back, two screw webs and two inwardly projecting reinforcement webs, the outer rail having a retention means for retaining one of the reinforcement webs when said one of the reinforcement webs is positioned in the retention means, wherein the retention means includes a stop pin, which extends linearly inwards from an inner side of one of the screw webs of the outer rail in a direction orthogonal to said first direction such as to form a stop for said one reinforcement web, and the stop pin further extending into a support flange, which extends in said first direction such as to form a support of said one reinforcement web, wherein the stop pin is fixed to the screw web of the outer rail at the point from which it extends linearly inwards, wherein the stop pin and the support flange form an L-shape, wherein the support flange includes a lock pin for engaging the reinforcement web of the intermediate rail, wherein an additional stop pin is disposed opposite the stop pin, and wherein the lock pin has resilient means for passage of an end part of the intermediate rail, the resilient means of the lock pin extending from and at an angle to the support flange towards the stop pin so as to form a lock and for retention of the end part against the stop pin.

2. Sectional rail system according to claim 1, wherein a plurality of said retention means are disposed with a spacing in longitudinal direction of the outer rail.

3. Sectional rail system according to claim 1, wherein at least an additional outer rail and intermediate rail are provided.

4. Sectional rail system according to claim 1, wherein each support flange on each stop pin is provided with one said lock pin.

5. Sectional rail system according to claim 1, wherein the sectional rail system furthermore includes at least one lintel rail and a plurality of intermediate rails arranged parallel to each other, whereby the distance between adjacent intermediate rails has uniform modular spacing, whereby the cross-section of the lintel rail corresponds to the cross-section of an outer rail, and whereby the lintel rail is provided with a number of retention means corresponding to the retention means of an outer rail.

6. Sectional rail system according to claim 5, wherein each end part of the lintel rail is provided with fastening means for fastening to an intermediate rail.

7. Sectional rail system according to claim 6, wherein the length of the lintel rail corresponds to a multiple of the modular spacing between intermediate rails.

8. Sectional rail system according to claim 6, wherein each of the intermediate rails is provided with a number of cutouts that correspond to the position of the fastening means of a lintel rail and spaced apart from any of the ends of the intermediate rail, the lintel rail abutting against the sectional back of the intermediate rail and against the reinforcement web of the intermediate rail.

9. Sectional rail system according to claim 6, wherein the fastening means of the lintel rail is constituted by at least one tongue with a locking device for inserting into and fastening to cutouts in an intermediate rail.

10. Sectional rail system according to claim 5, wherein the sectional rail system further includes at least one door side section, wherein each end part of the door side section is provided with fastening means at one end thereof for fastening to an outer rail, and at the other end thereof provided with fastening means for fastening to a lintel rail.

11. Sectional rail system according to claim 1, wherein rail system assembly is performed by pushing said end part of the intermediate rail in against the stop pins of the outer rail by letting the reinforcement web of the intermediate rail pass the resilient means of the lock pin, whereby the resilient means are temporarily deformed resiliently in order to return entirely or partly to the initial position of the resilient means after passage of the stop pin.

12. Sectional rail system according to claim 11, wherein the intermediate rail is attachable to the outer rail by a translational movement in the longitudinal direction of the outer rail.

13. Sectional rail system according to claim 1, wherein said angle formed between the support flange and the resilient means of the lock pin is less than 45°.

14. Sectional rail system according to claim 1, wherein an angle of the L-shape formed by the stop pin and the support flange is approximately 90 degrees, the support flange extending substantially linearly in the first direction.

15. Sectional rail system according to claim 14, wherein the resilient means extends substantially linearly towards the stop pin.

* * * * *